US005638622A

United States Patent [19]

Höhn

[11] Patent Number: 5,638,622

[45] Date of Patent: Jun. 17, 1997

[54] STEAM IRON WITH PUMP AND PRESSURE RESERVOIR

[75] Inventor: Dieter Höhn, Riedstadt, Germany

[73] Assignee: Rowenta-Werke GmbH, Offenbach am, Germany

[21] Appl. No.: 670,896

[22] Filed: Jun. 26, 1996

[30] Foreign Application Priority Data

Jul. 4, 1995 [DE] Germany ..... 195 24 333.1

[51] Int. Cl.[6] ..... D06F 75/24

[52] U.S. Cl. ..... 38/77.5; 38/77.81

[58] Field of Search ..... 38/77.1, 77.7, 38/77.5, 77.81, 77.82; 219/250, 254

[56] References Cited

U.S. PATENT DOCUMENTS

| | | | |
|---|---|---|---|
| 5,042,179 | 8/1991 | Van Der Meer | 38/77.83 |
| 5,341,585 | 8/1994 | Stephan et al. | 38/77.81 X |
| 5,430,963 | 7/1995 | Kuo-Chu | 38/77.83 X |

FOREIGN PATENT DOCUMENTS

| | | | |
|---|---|---|---|
| 2136191 | 5/1990 | Japan | 38/77.83 |
| 2195994 | 8/1990 | Japan | 38/77.83 |
| 2305600 | 12/1990 | Japan | 38/77.83 |
| 6205897 | 7/1994 | Japan . | |

*Primary Examiner*—Ismael Iaguirre

*Attorney, Agent, or Firm*—Cohen, Pontani, Lieberman, Pavane

[57] ABSTRACT

A steam iron with an electric pump for conveying water from a water tank to individual water consumers and control electronics, which control the pump as a function of actuated cut-off valves. The control electronics recognize and control the different operating modes associated with the respective water consumers as a function of pressure changes in the pressure control circuit. The operating duration of the pump is restricted to a maximum time in accordance with the respective operating mode.

5 Claims, 4 Drawing Sheets

STEAM IRON WITH PUMP AND PRESSURE RESERVOIR

BACKGROUND OF THE INVENTION

1. Field of the Invention

The invention relates to a generic-type steam iron.

2. Description of the Related Art

A steam iron is known from DE-PS 42 14 564 which comprises an electric pump, which conveys water from the water tank via a pressure reservoir to the individual consumers, such as the evaporation chamber, the auxiliary evaporation chamber and the spray device. In order to spray the material which is to be ironed in the region in front of the iron and for steam production, corresponding cut-off valves are actuated from outside the iron by way of manual actuating members. The valves are coupled for the production of steam to control electronics via electric switches.

This known steam iron has the disadvantage that an additional electric switch is required for the production of additional steam. This additional switch interrupts the electric circuit of the pump via the control electronics during actuation of the corresponding cut-off valve in order to prevent the auxiliary evaporation chamber from flooding. Consequently, this known steam iron is still too complicated with regard to its control technology.

SUMMARY OF THE INVENTION

Accordingly, it is an object of the present invention to provide a steam iron which can be manufactured in a simpler fashion with respect to control technology and can therefore be produced in a more assembly-friendly, reliable and cost-effective manner.

Pursuant to this object, and others which will become apparent hereafter, one aspect of the present invention resides in a steam iron having a water tank, individual water consumers, an electric pump for conveying water from the water tank via supply lines to the individual water consumers, a pressure reservoir arranged between the pump and the water consumers, which pressure reservoir includes switch means for signaling a maximum water level in the pressure reservoir, a plurality of manually actuable cut-off valves, a switch associated with one of the cut-off valves, and control electronics operatively connected with the switch, the switch means and the pump for controlling different operating modes of the pump and permitting unlimited pump operation time as a function of actuation of the cut-off valves, the switch and the switch means. The control electronics are further operative to recognize and control different operating modes of the pump associated with the individual water consumers as a function of pressure changes in a pressure control circuit. The control electronics limit the operating time of the pump to a maximum time in accordance with the respective operating mode.

As a result of the different dimensioning—as regards flow resistance—of the outlet for the additional steam, comprising a cut-off valve, water hose and metal pipe on the one hand, and the outlet for the spray device, comprising a cut-off valve, water hose and spray nozzle on the other hand, the switch which is coupled to the pressure reservoir carries out different switching cycles, which can be differentiated by the control electronics as an additional steam operation or a spraying operation. The usual spraying operation and the capacity-restricted operation of the electric pump required for this process is actuated by a second switch coupled to the steam valve and the control electronics. In an advantageous manner, the fact that the pump is switched off after a predetermined response time during steam jet mode prevents the auxiliary evaporation chamber from being flooded and the electric pump is prevented from running dry—which would cause damage—when the water tank is empty.

As a result of the invention, there is no need for the additional electric switch which is required in the state of the art for generating additional steam and which interrupts the electric circuit via the control electronics upon actuation of the corresponding cut-off valve. Consequently, the invention offers a substantial simplification of the control technology and assembly whilst improving the reliability of the iron.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
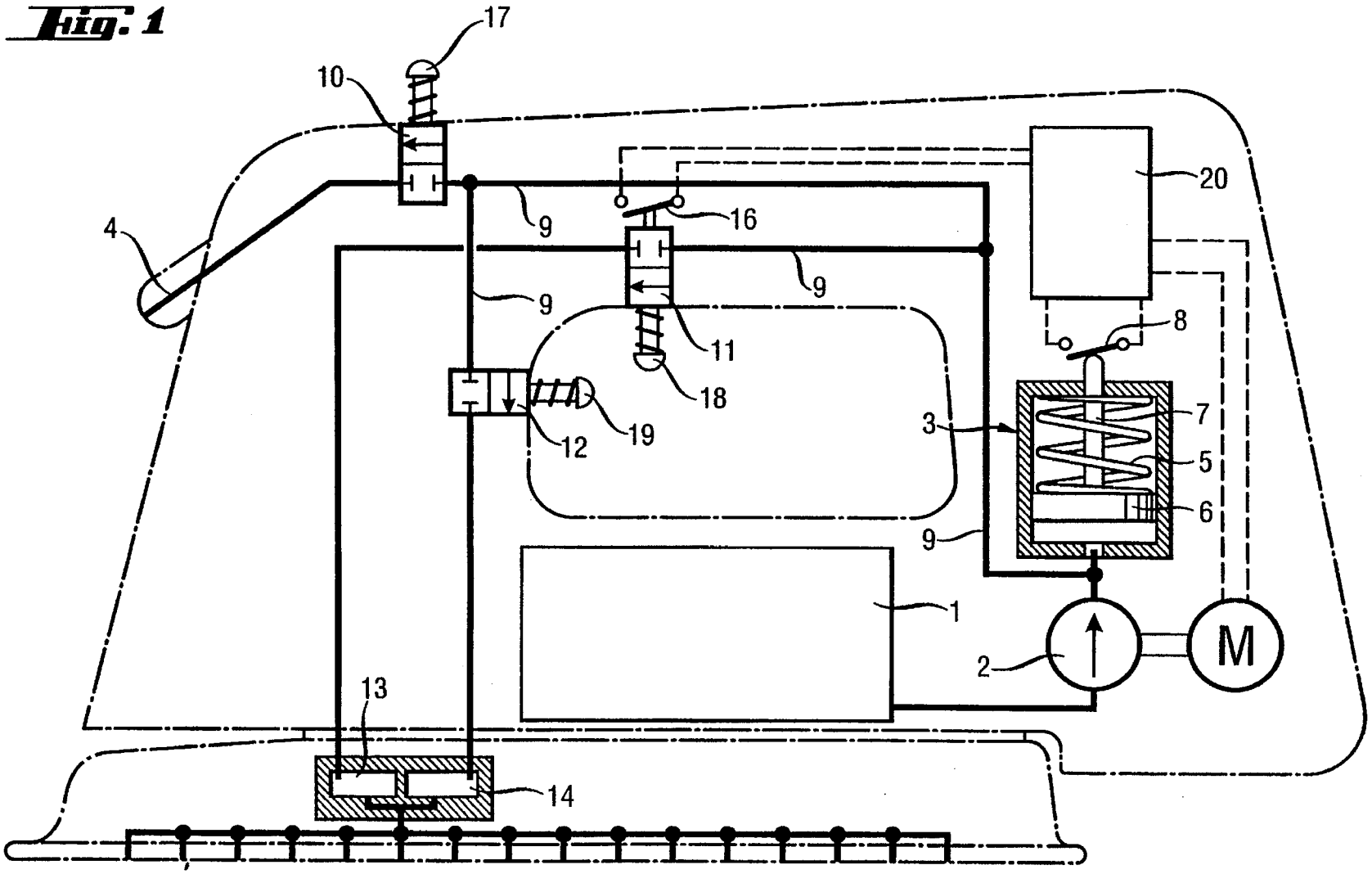
FIG. 1 is a schematic view of the steam iron according to the present invention.
Figure 2:
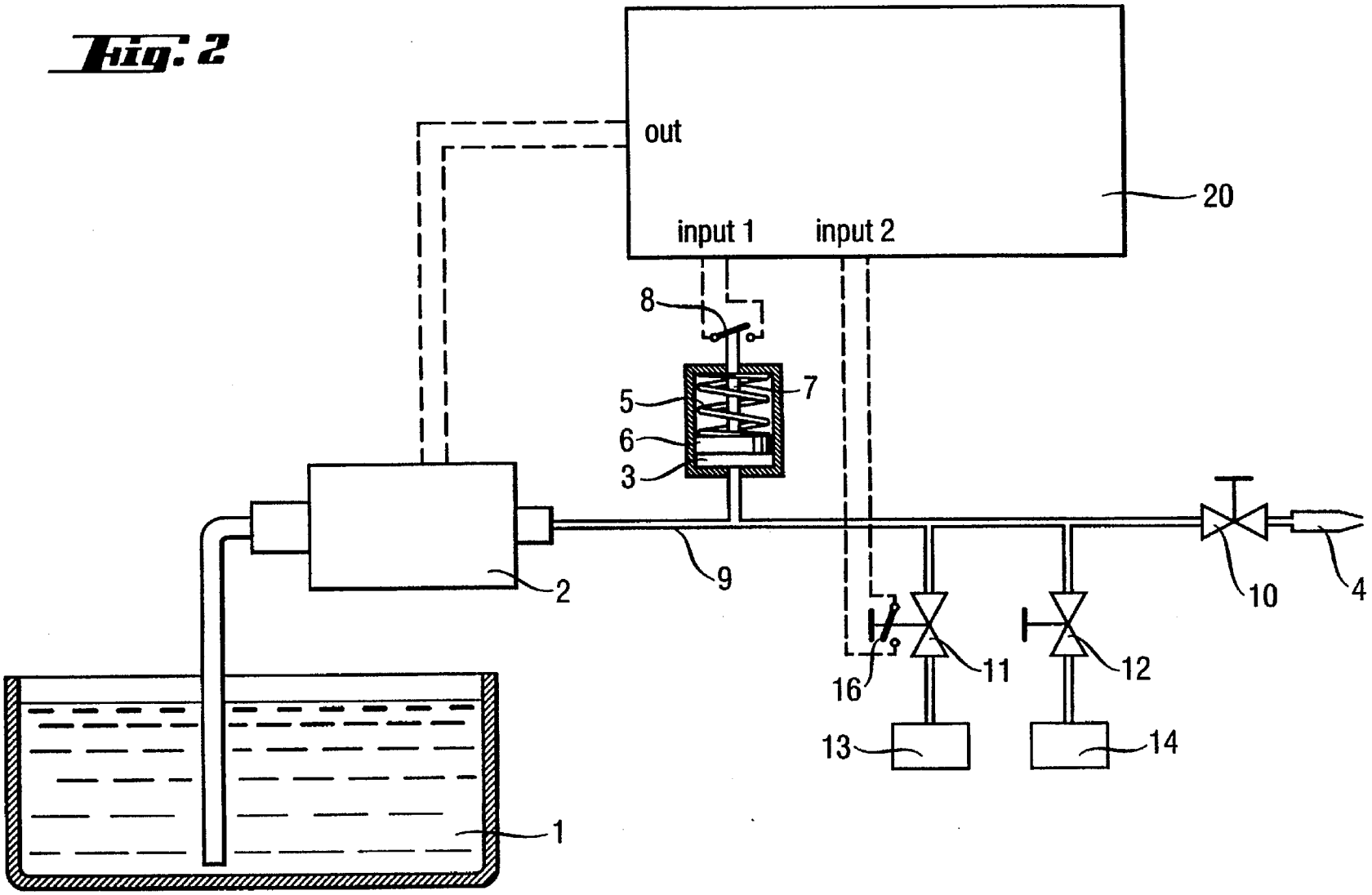
FIG. 2 is a circuit diagram of a steam iron according to FIG. 1.

The steam iron schematically illustrated in FIGS. 1 and 2 comprises a water tank 1, an electric pump 2, a pressure reservoir 3 and a spray device 4. The cylindrical pressure reservoir 3 is constructed as a pressure-loaded water reservoir. A piston 6 that is displaceable by the pressure of a spring 5 is arranged inside the pressure reservoir 3. The piston rod 7 of the piston 6 is in operative connection with an electric switch 8. The pump 2 and the pressure reservoir 3 are connected via supply lines 9 and cut-off valves 10, 11 and 12 to water consumers, namely an evaporation chamber 13, an auxiliary evaporation chamber 14 and the spray device 4. The actuation of the cut-off valves 10, 11 and 12 is effected manually via manual actuation members 17, 18 and 19. The valve 11 is in operative connection with control electronics 20 via an electric switch 16 connected to the valve 11. Once the maximum water level of the pressure reservoir 3 is reached, the switch 8 is actuated by the piston rod 7 and the pump 2 is switched off. In contrast, if the water level in the pressure reservoir 3 falls below a certain level, the pump 2 is switched on again via the switch 8. The pump 2 and the pressure reservoir 3 thus form a control circuit which ensures that there is always sufficient water at the outlet of the supply line 9 and that the water always has the required water pressure, since the water withdrawn from the pressure reservoir 3 is immediately replaced. The optimum operating pressure for the entire water storage system is adjustable in the pressure reservoir 3.

Figure 3:
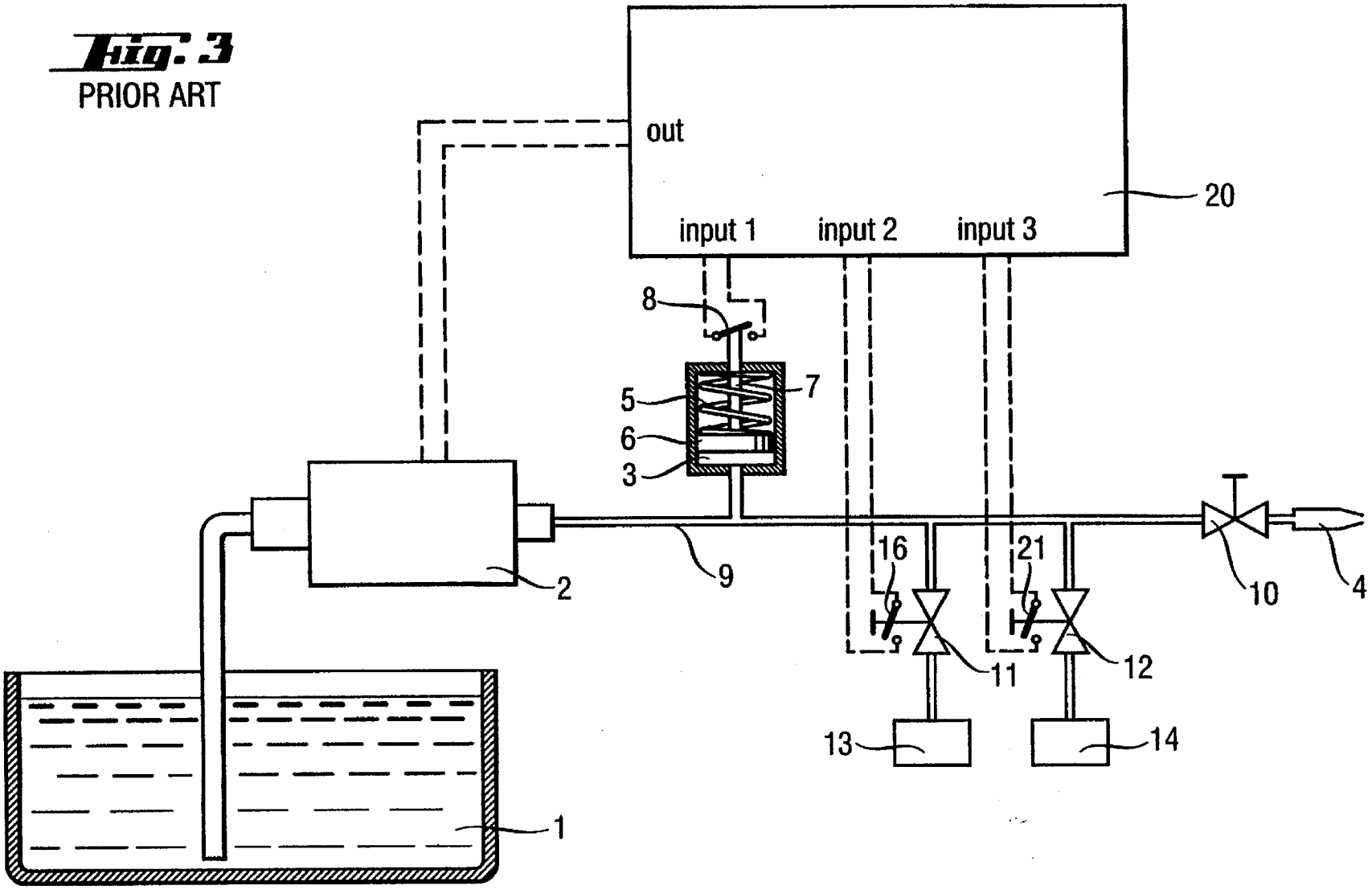
Fig. 3 PRIOR ART
FIG. 3 is a circuit diagram of a steam iron according to the prior art.

FIG. 3 illustrates the prior art in a schematic drawing similar to FIG. 2. It can be seen that a further switch 21 is required for generating additional steam, the further switch 21 switching off the pump 2 via the control electronics when the valve 12 is actuated, thereby preventing the auxiliary evaporation chamber 14 from flooding.

In the operating condition, the iron is switched on and the pump 2 conveys water into the pressure reservoir 3. Once the maximum water level is reached, the pump 2 is switched off and the water is ready for use at the optimum operating pressure upstream of the valves 10, 11 and 12.

Figure 4:
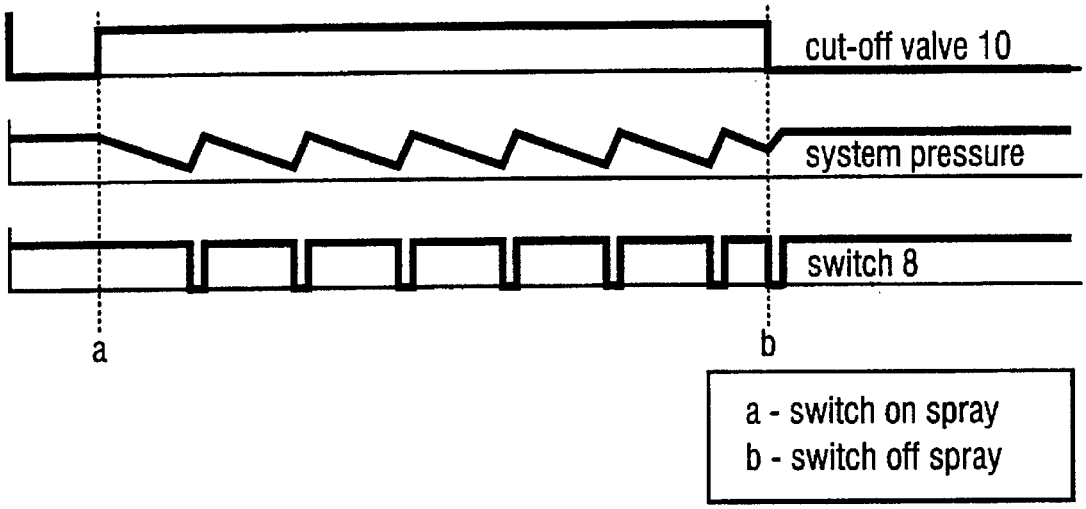
FIG. 4 is a graph illustrating spraying operation.

In order to spray the material which is to be ironed with cold water, the valve 10 is opened via the manual actuating member 17. The water pressure then falls until the reconnection level is reached in the pressure reservoir 3 and the pump 2 conveys more water into the reservoir. The relationship between the conveying rate of the pump 2 and the withdrawal rate of the valve 10 and the spray nozzle 4 is measured in such a manner that water volume in the pressure reservoir 3 can increase even though water is being withdrawn via the open valve 10, so that the maximum water level is quickly reached again and the pump 2 is switched off. The cycle then begins again, as illustrated in FIG. 4. As a result of this cycle, the control electronics 20 recognizes that the spraying operation is activated and allows this function without imposing any time limit on the pump operation. The withdrawal of water is effected at a system pressure which varies throughout the cycle and with intermittent pump operation.

Figure 5:
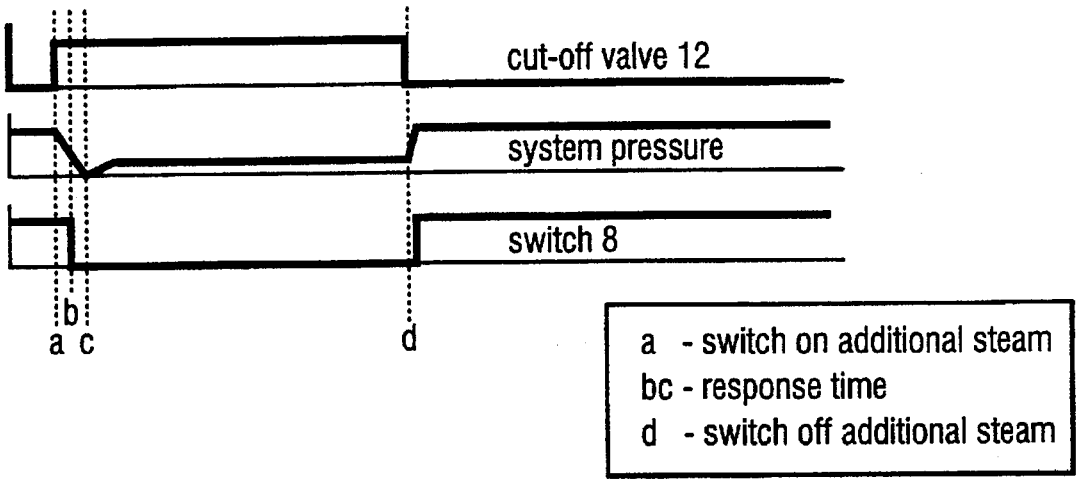
FIG. 5 is a graph illustrating steam jet operation.

In order to generate additional steam, the valve 12 is opened via the manual actuating member 19. As a result of the large quantity of water which is withdrawn, the water level in the pressure reservoir 3 and therefore the system pressure falls extremely rapidly on account of the low flow resistance, so that the pump 2, the switch 8 and the control electronics 20 are actuated. However, the maximum water level in the pressure reservoir 3 cannot be attained due to the large quantity of water which is being withdrawn. When the switch 8 on the pressure reservoir 3 fails to transmit a signal within a given period of time, the control electronics 20 recognize active additional steam operation and restrict the duration of the pump operation to a given maximum time $t_{max}$. This prevents flooding of the auxiliary evaporation chamber 14. A lack of water also advantageously results in an absence of the signal from the switch 8, since the maximum water level in the pressure reservoir 3 cannot be attained when the tank 1 is empty. As with the additional steam generation, the control electronics 20 then restrict the operating time of the pump 2, which is now running dry, to the maximum time $t_{max}$. This is shown in FIG. 5.

To produce normal steam, the valve 11 is opened by the user via the manual actuating member 18 and the coupled switch 16 is simultaneously actuated. The signal from the switch 16 causes the control electronics 20 to render the pressure control and the time restriction $t_{max}$ inoperative and to set the pump 2 to pulsed half-wave operation, the cycle time being adjustable by the user, e.g. with the aid of a potentiometer on the control electronics 20.

The invention is not limited by the embodiments described above which are presented as examples only but can be modified in various ways within the scope of protection defined by the appended patent claims.

I claim:

1. A steam iron, comprising: a water tank; individual water consumers; an electric pump; supply lines that place the water tank, the electric pump and the individual water consumers in fluid communication, the electric pump being operative to convey water from the water tank via the supply lines to the individual water consumers; a pressure reservoir arranged between the pump and the water consumers; switch means for signaling a maximum water level in the pressure reservoir; a plurality of manually actuable cut-off valves; a switch associated with one of the cut-off valves to indicate actuation of the cut-off valve; and control electronics in operative connection with the switch, the switch means and the pump and being operative to control different operating modes of the pump and to permit unlimited pump operation time as a function of actuation of the cut-off valves, the switch and the switch means, the control electronics being further operative to recognize and control the different operating modes of the pump associated with the individual water consumers as a function of pressure changes in a pressure control circuit, and to limit operating time of the pump to a maximum time in accordance with a respective operating mode.

2. A steam iron according to claim 1, wherein the pressure control circuit includes the pump, the pressure reservoir, the switch means, and the control electronics, the control electronics being operative to discontinuously control pressure of the pressure reservoir and change an on-off-on cycle of the switch means responsive to the pressure changes in the pressure control circuit.

3. A steam iron according to claim 1, wherein the individual water consumers include a spray device.

4. A steam iron according to claim 1, wherein the individual water consumers include an auxiliary evaporation chamber.

5. A steam iron according to claim 1, wherein the individual water consumers include an evaporation chamber.

* * * * *